US006655571B2

(12) United States Patent
Ueno

(10) Patent No.: US 6,655,571 B2
(45) Date of Patent: Dec. 2, 2003

(54) FASTENING ELEMENT ATTACHING DEVICE

(75) Inventor: Hideyuki Ueno, Kanagawa (JP)

(73) Assignees: Kotec's Co., Ltd., Tokyo (JP); Sanyo Seisakusho Co., Ltd., Aichi (JP)

( * ) Notice: Subject to any disclaimer, the term of this patent is extended or adjusted under 35 U.S.C. 154(b) by 208 days.

(21) Appl. No.: 09/803,093

(22) Filed: Mar. 12, 2001

(65) Prior Publication Data

US 2001/0020634 A1 Sep. 13, 2001

(30) Foreign Application Priority Data

Mar. 10, 2000 (JP) ..... 2000-066973

(51) Int. Cl.[7] ..... A43D 69/00
(52) U.S. Cl. ..... 227/67; 227/140; 227/109
(58) Field of Search ..... 227/67, 109, 140, 227/26, 114; 29/432

(56) References Cited

U.S. PATENT DOCUMENTS 2,982,595 A * 5/1961 Rogers, Jr. ..... 227/136
3,717,294 A * 2/1973 Green ..... 227/19
3,901,428 A * 8/1975 Grass ..... 227/67
3,910,324 A * 10/1975 Nasiatka ..... 81/434
3,971,421 A * 7/1976 Damratowski ..... 81/434
4,367,837 A * 1/1983 Manino ..... 227/136
4,416,407 A * 11/1983 Bone ..... 227/67
4,683,635 A * 8/1987 Duchin ..... 29/432
4,690,317 A * 9/1987 Hamisch et al. ..... 227/67
5,090,490 A * 2/1992 Block ..... 173/171
5,683,025 A * 11/1997 Grendol ..... 227/67
5,772,073 A * 6/1998 Deschenes ..... 221/197
5,950,901 A * 9/1999 Kubota ..... 227/71

FOREIGN PATENT DOCUMENTS

GB 2 180 488 A 4/1987
GB 2 316 350 A 2/1998

* cited by examiner

*Primary Examiner*—Rinaldi I. Rada
*Assistant Examiner*—Louis Tran
(74) *Attorney, Agent, or Firm*—Young & Thompson

(57) ABSTRACT

To provide a safe fastening element attaching device as well as to improve the operability thereof.

The present invention provides a fastening element attaching device for sequentially pushing out the lowest fastening element from an interior of a fastening element group, in which a plurality of fastening elements are formed integrally by a connection bar, comprises a switching mechanism for selectively discharging the foregoing connection bar, which remains after respective fastening elements are pushed out from the foregoing connection bar, from a plurality of places of the main portion of the device. Therefore, the safety of the fastening element attaching device is increased as well as the operability thereof is improved.

5 Claims, 10 Drawing Sheets

FASTENING ELEMENT ATTACHING DEVICE

BACKGROUND OF THE INVENTION

1. Field of the Invention

The present invention relates to a fastening element attaching device, which is capable of binding up the clothes and socks or the like and attaching tags such as a brand label, a price tag, material explanation and direction for use or the like to the commodities by inserting the fastening elements into the commodities.

2. Description of the Related Art

Generally, in order to bind up the clothes, the daily fancy goods, the slippers and the shoes or the like and effectively attach a brand label and a price tag or the like to the above commodities, various fastening element attaching devices have been conventionally used.

For example, according to the conventional fastening element attaching device, for example, as shown in Japanese Unexamined Utility Model Application (KOKAI) No. 5-51715, having a hollow needle, which is attached to a front edge of a main body, a push rod, which goes in and out from the foregoing hollow needle, a guide groove, which is disposed on an entrance of the foregoing hollow needle, a fastening element feeding ratchet, which is disposed on the entrance side of the foregoing hollow needle with facing to the foregoing guide groove and a stopper, which is disposed laterally right beside of the foregoing feeding ratchet, a plurality of fastening elements, which are tentatively and lengthwisely connected by a connection bar to form into one body, is disposed from above on the front part of the main body of the device, and in which the entrance of the foregoing guide groove is provided at a portion apart with some distance from the foregoing hollow needle and the length of the foregoing guide groove formed between the foregoing hollow needle entrance to an entrance of the foregoing guide groove, or to an exit of the guide groove is set as long as possible. Further, the fastening elements is inserted into the groove and the lowest fastening element is always and successively pushed out by the lever operation from the fastening element group. Additionally, the connection bar, which remains inside the device after at least some of the fastening elements had been pushed out, is discharged from a front lower part of the main body of the device.

However, if the length of the fastening element group is longer, the above described conventional fastening element attaching device involves a problem such that when the fastening element is used for the commodities, for example, the clothes or the like, the connecting bar after the fastening element had been removed therefrom, tears down the commodities after pushing out the fastening elements or it hurts a finger of the operator.

Especially, the connection bar after pushing out the fastening elements is very danger, since a trace formed after when the fastening elements had been taken out, is sharp. Alternatively, there is a case that the connection bar itself, which extends longer in the upper direction or the lower direction in the front part of a main body the device, becomes an obstacle against the operation.

However, considering a manufacturing cost, the fastening element group is capable of being provided at a low price when the total length of the fastening element is made longer. This is because the fastening element group is made by utilizing one metal mold.

Therefore, an object of the present invention is to provide a fastening element attaching device, which is capable of selecting discharging positions depending on each usage by selectively discharging an end of the connecting bar from a lower part or a rear part of a fastening element attaching device.

SUMMARY OF THE INVENTION

The present invention has been made taking the foregoing problem into consideration, an object of which is to provide a constitution basically described below. That is to say, the present invention provides a fastening element attaching device for sequentially detaching respective fastening elements from a connection bar by an operational lever from a fastening element group, in which a plurality of fastening elements are formed integrally by the connection bar, comprising a switching mechanism for selectively discharging the foregoing connection bar, which remains inside the device after respective fastening elements had been detached from the foregoing connection bar, from a plurality of places of a main portion of the device.

In order to solve the above described problems in the conventional art, a fastening element attaching device according to the present invention for sequentially pushing out the lowest fastening element among the fastening elements group in which a plurality of fastening elements are formed integrally by the connection bar, at every time when the above described conventional lever is operated, comprises a switching mechanism for selectively discharging the foregoing connection bar, which remains inside the device after respective fastening elements had been detached from the foregoing connection bar, from a plurality of places of a main portion of the device.

Therefore, in the case that the connection bar disturbs the operation, it is possible to discharge the connection bar from a rear part of the main portion of the device.

DESCRIPTION OF THE PREFERRED EMBODIMENTS

Figure 1:
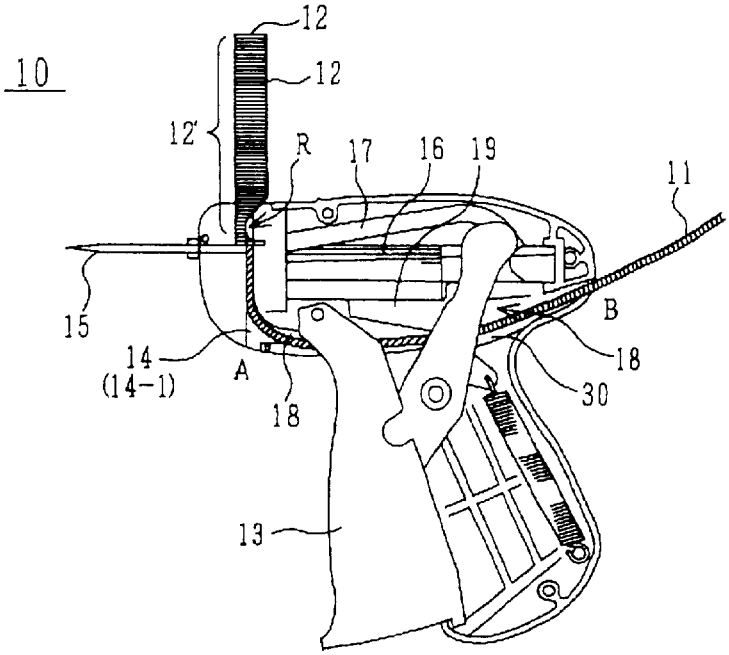
FIG. 1 is a side elevation view for illustrating an interior construction of a fastening element attaching device according to the present invention.

An embodiment of the fastening element attaching device according to the present invention will be explained below with reference to the drawings. FIG. 1 is a side elevation view for illustrating an interior construction of a fastening element attaching device according to the present invention. In FIG. 1, a fastening element attaching device 10 according to the present invention sequentially pushes out the lowest fastening element by operating an operational lever 13 from an interior of a fastening element group 12', in which a plurality of fastening elements 12 are formed integrally by a connection bar 11. Alternatively, the foregoing fastening element attaching device 10 according to the present invention is capable of selectively discharging the foregoing connection bar 11, which remains inside the device after respective fastening elements in the fastening element group 12' had been pushed out from the foregoing connection bar 11, by a switching mechanism 14 from two places of the main portion of the device, i.e., from substantially directly under part A of a detaching operation performing part and from a rear part B of the main portion of the device. In other words, when the length of the fastening element group 12' is short, the connection bar 11 is discharged from a portion on the device which is close to the hollow needles, to an exterior of the present device, and when it is long, the connection bar 11 is discharged to a rear edge of the device through an interior of the main portion of the device. Alternatively, it is possible to dispose a guide member 30 in the main portion of the device to guide the connection bar 11 which remains inside the device after the fastening elements had been detached.

Figure 2:
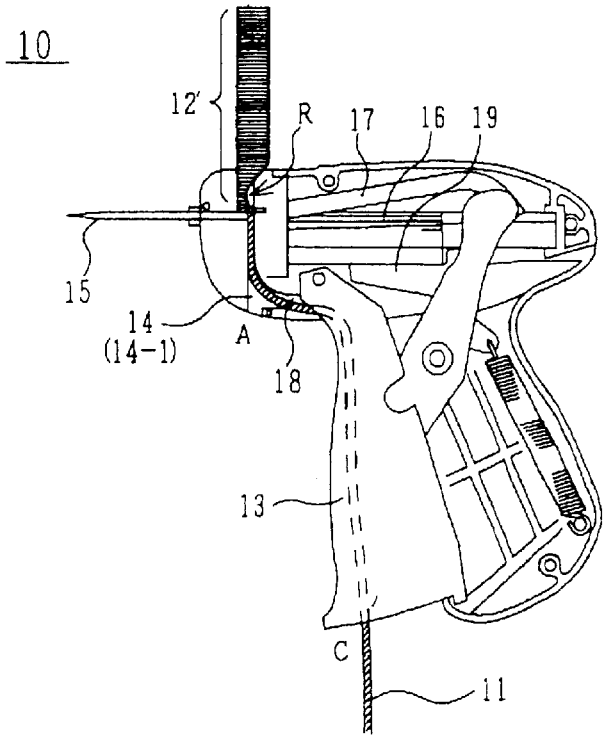
FIG. 2 is a side elevation view for illustrating other embodiment of the fastening element attaching device according to the present invention.

Further, FIG. 2 is a side elevation view for illustrating other embodiment of the fastening element attaching device according to the present invention. According to the embodiment, it is possible that the connection bar 11 which remains inside the device after the fastening elements had been detached is guided inside the operational lever 13 to be discharged from a lower edge C of the present operational lever 13.

A hollow needle 15 is attached to a front end of the main portion of the device. A pushed out pin 16 to be inserted in this hollow needle 15 is shifted by the operation of the operational lever 13. When the pushed out pin 16 is inserted in the hollow needle 15, for example, the lowest fastening element, which is disposed in a groove R of the main portion of the device, is sequentially detached from the connection bar 11 to be pushed out. Additionally, a feeding ratchet 17 sequentially pushes down the fastening elements one by one. Additionally, after the fastening elements are detached from the connection bar 11 and are pushed out, the connection bar 11 is discharged to an exterior of the main portion of the device. In this time, the switching mechanism 14 is employed to select a discharging route of the connection bar. In the embodiments shown in FIGS. 1 to 4, the switching mechanism 14 is replaced with a detachable switching member 14-1. The switching member 14-1 is detachably configured on a discharging orifice A, which is defined on the front lower side of the main portion of the device. When the switching member 14-1 is not used, the connection bar 11 is discharged from a first passage 22 and when the switching member 14-1 is used, a curved part **14*a* alters a course of discharging route of the connection bar 11, which is discharged from the backward through a second passage 18**.

The curved part **14*a* guides a front edge of the connection bar 11, which is descending, into the second passage 18, which is defined in the main portion of the device, when the curved part 14*a*** is inserted in the discharging orifice A.

Figure 3:
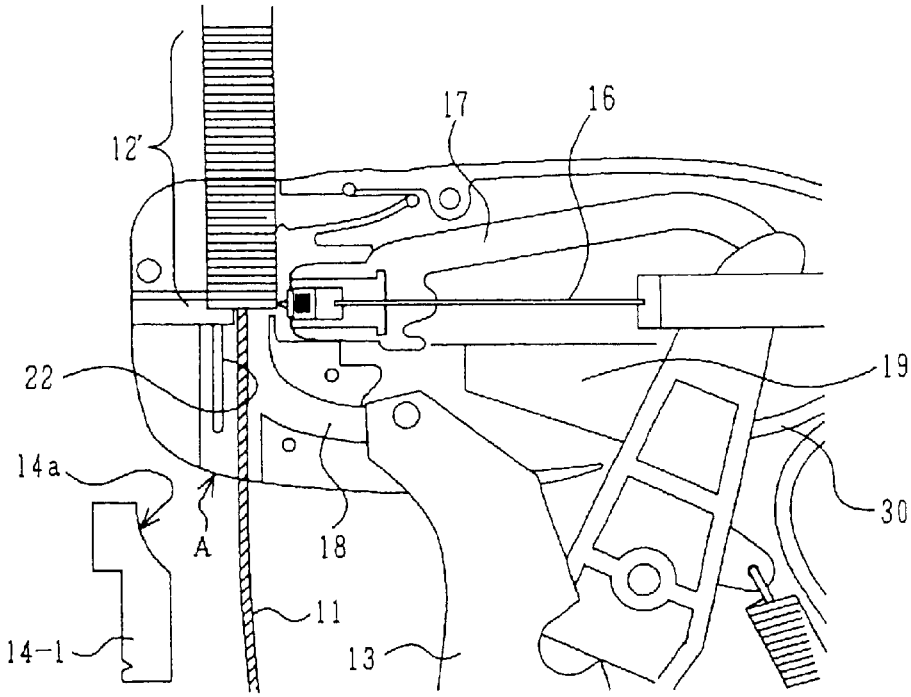
FIG. 3 is a side elevation view, in which substantial parts are enlarged, for illustrating an interior construction of the fastening element attaching device according to the present invention.

The second passage 18 is defined in an interior of the lower edge of the main portion of the device and has a discharging orifice B at the rear edge thereof. Additionally, the second passage 18 has a support plate 19 at the side surface thereof. FIG. 3 shows a case that the switching member 14-1 is removed from the main portion of the device and thereby the connection bar 11 is discharged from the discharging orifice A.

Figure 4:
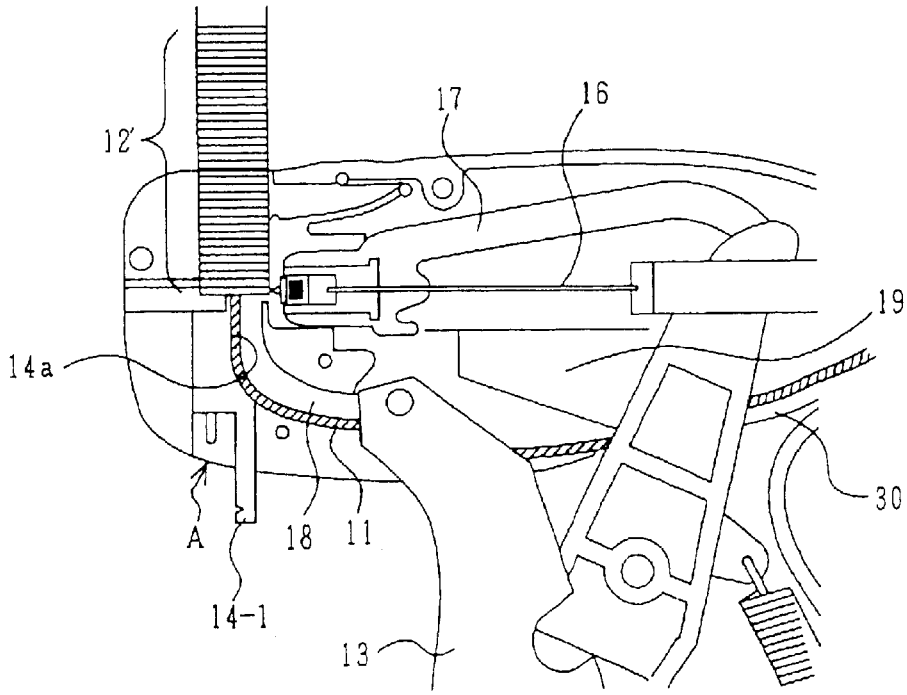
FIG. 4 is a side elevation view, in which substantial parts are enlarged, for illustrating an operational state of the fastening element attaching device according to the present invention.

In the case that the length of the fastening element group 12' is short, the transit resistance becomes small when the connection bar 11 is discharged from the discharging orifice A. FIG. 4 shows a case in that the switching member 14-1 is mounted to the discharging orifice A. In this case, the connection bar 11 is discharged from the discharging orifice B of a rear part of the main portion of the device.

In the case that the connection bar 11 is discharged from the discharging orifice B of the rear part of the main portion of the device, the operation is not disturbed and the operability is improved. Alternatively, the commodities are not hurt.

Figure 5:
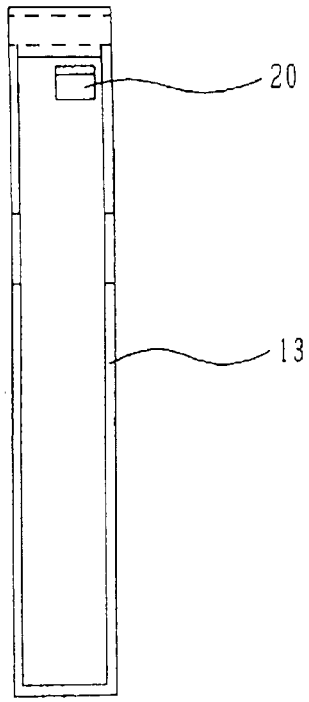
FIG. 5 is a rear view illustrating a lever member, which is used in the fastening element attaching device according to the present invention.

FIG. 5 is a rear view showing an operational lever 13, which is used to press the fastening elements, when the fastening elements are pushed out, according to the fastening element device of the present invention. Here, in the upper vicinity of the operational lever 13, a passage orifice 20 is defined such that the connection bar 11 passes through. Owing to this passage orifice 20, the operational lever 13 is not disturbed even when the connection bar 11 passes through the second passage 18.

Figure 6:
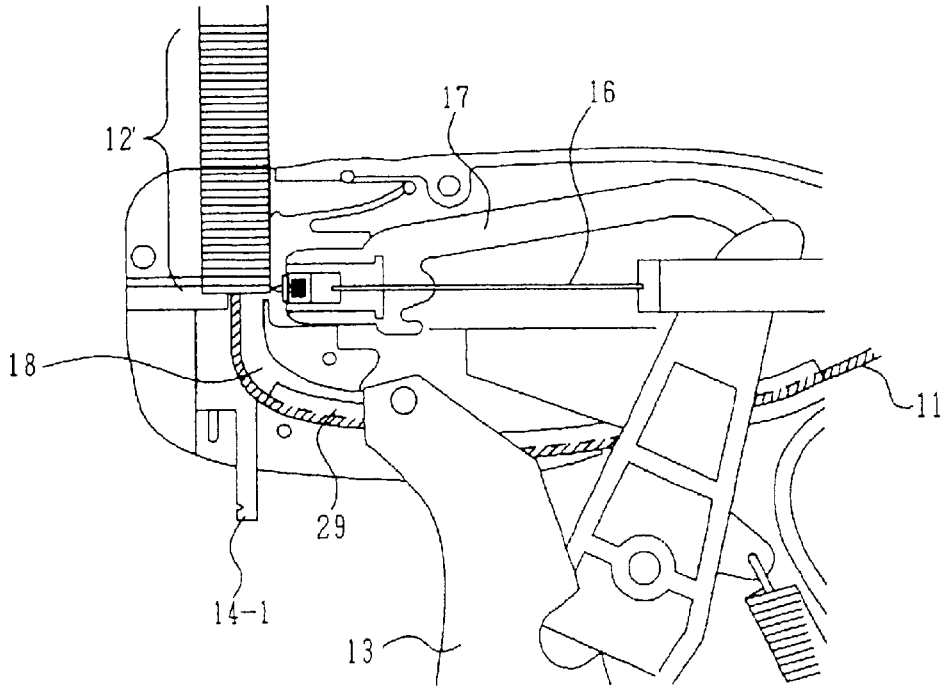
FIG. 6 is a side elevation view for illustrating a second embodiment of the fastening element attaching device according to the present invention.

FIG. 6 is a side elevation view for illustrating a second embodiment such that the above switching member 14-1 is disposed to the fastening element attaching device according to the present invention. According to the embodiment, the connection bar 11 is guided by a tube member 29 after the fastening element is pushed out. According to the embodiment, under the condition that the tube member 29 guides the connection bar 11 toward the second passage 18, it is possible to smoothly shift the connection bar 11.

Figure 7:
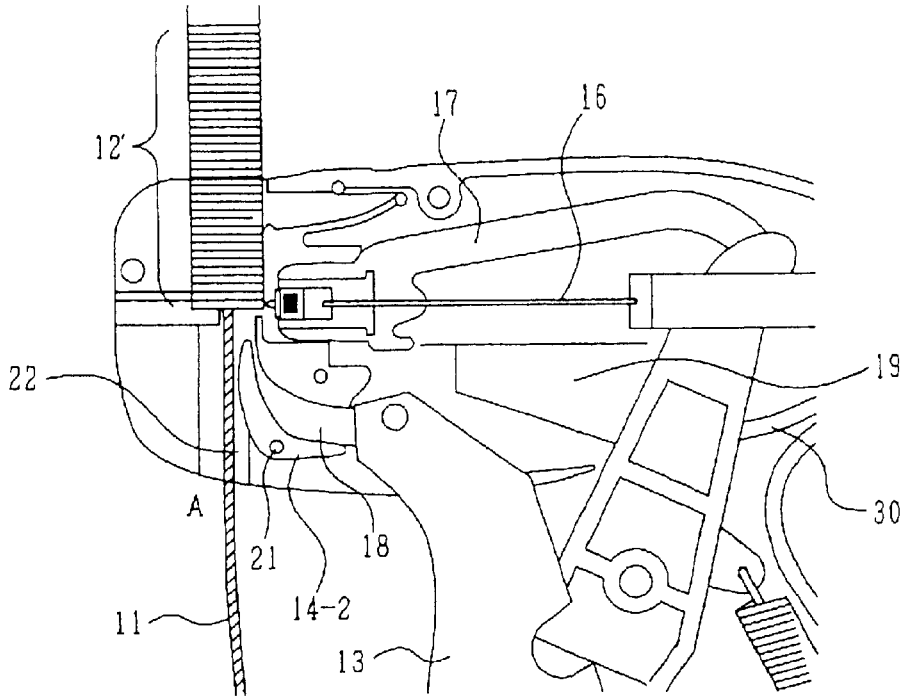
FIG. 7 is a side elevation view for illustrating a third embodiment of the fastening element attaching device according to the present invention.
Figure 8:
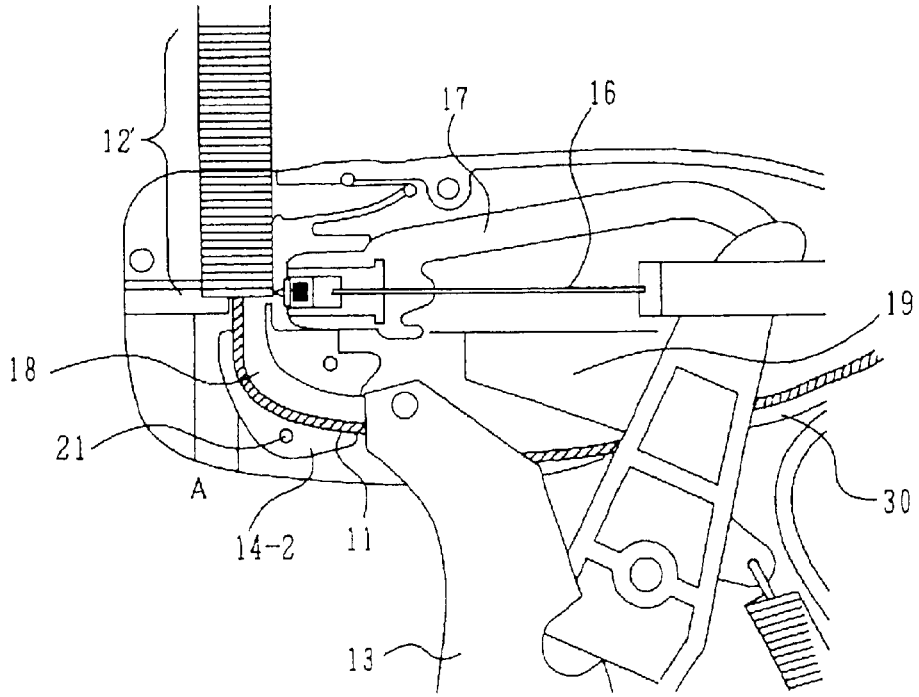
FIG. 8 is a side elevation view for illustrating a third embodiment of the fastening element attaching device according to the present invention.

FIGS. 7 and 8 are side elevation views for illustrating a third embodiment of the fastening element attaching device according to the present invention. According to the embodiment, the switching mechanism is configures by a switching member 14-2, which is rotated by the switching lever (not illustrated here). The switching member 14-2 is shaped in a lune, which rotates around a shaft 21. If the switching member 14-2 is rotated clockwise as shown in FIG. 7, the second passage 18 is closed and the connection bar 11 is guided to the first passage 22 to be discharged from the discharging orifice A. Alternatively, if the switching member 14-2 is rotated counterclockwise as shown in FIG. 8, the first passage 22 is closed and the connection bar 11 is guided to the second passage 18. Accordingly, the connection bar 11 is discharged from the discharging orifice B of the rear part of the main portion of the device.

Figure 9:
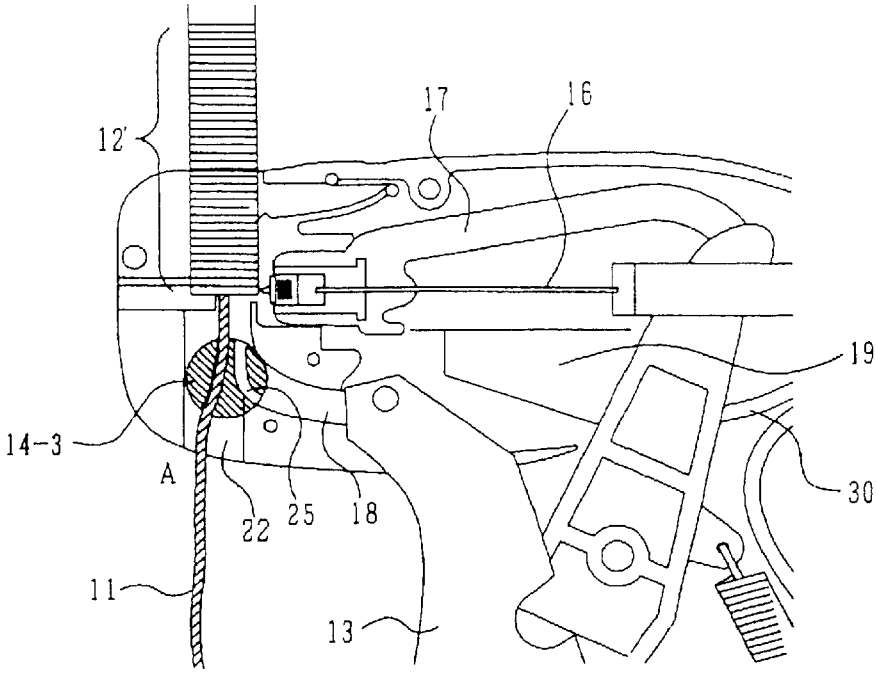
FIG. 9 is a side elevation view for illustrating a fourth embodiment of the fastening element attaching device according to the present invention.
Figure 10:
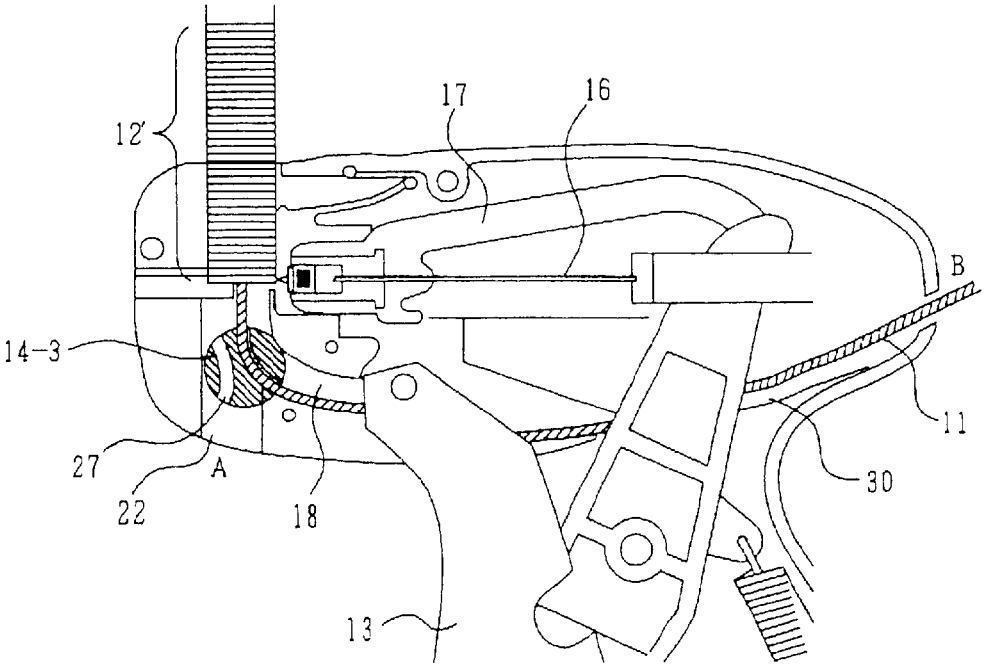
FIG. 10 is a side elevation view for illustrating a fourth embodiment of the fastening element attaching device according to the present invention.

FIGS. 9 and 10 are side elevation views for illustrating a fourth embodiment of the fastening element attaching device according to the present invention. According to the present invention, the switching mechanism is configured by a rotary switching member 14-3 and the switching mechanism is capable of altering a course of the connection bar by a switching lever 23 shown in FIG. 11. A section of the switching member 14-3 has a substantially circular form and two passages 24 and 25 are established. Additionally, it is possible to rotate the switching member 14-3 by the switching lever 23.

FIG. 9 shows a case that the switching member 14-3 is rotated clockwise in the drawing and the connection bar 11 is guided to the passage 24. When the connection bar 11 is guided to the passage 24, the connection bar 11 is discharged from the discharging orifice A of a lower edge of a front part of the main portion of the device. Additionally, FIG. 10 shows a case that the switching member 14-3 is rotated counterclockwise in the drawing and the connection bar 11 is guided to the passage 25. If the connection bar 11 is guided to the passage 25, the connection bar 11 is discharged from the discharging orifice B of the rear part of the main portion of the device through the second passage 18 of the main portion of the device. According to the embodiment, it is possible to switch the discharging position through one touch operation by the switching lever 23.

Figure 11:
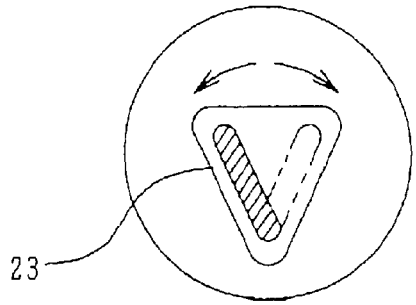
FIG. 11 is an explanatory view for illustrating a switching lever part of the fastening element attaching device according to the present invention.
Figure 12:
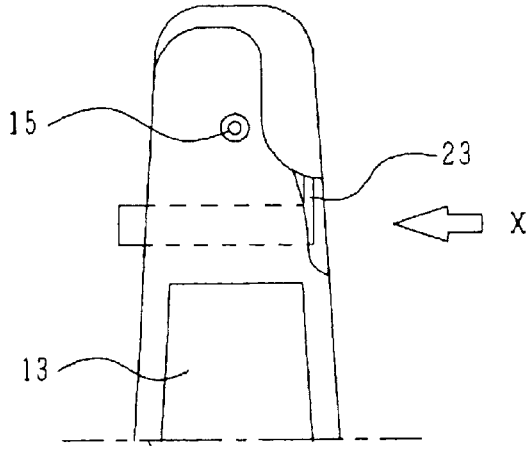
FIG. 12 is an explanatory view for illustrating an operational procedure of a switching lever, which is used in the fastening element attaching device according to the present invention.
Figure 13:
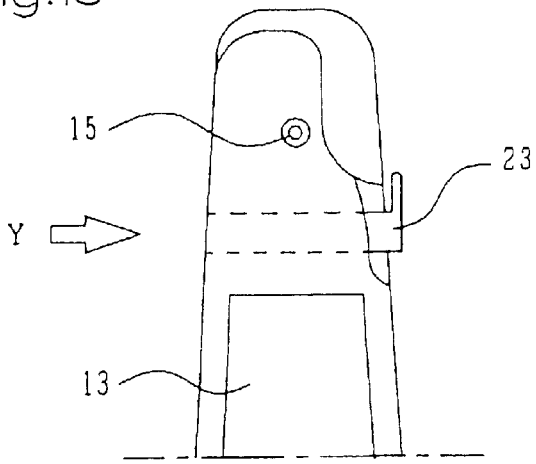
FIG. 13 is an explanatory view for illustrating an operational procedure of a switching lever, which is used in the fastening element attaching device according to the present invention.
Figure 14:
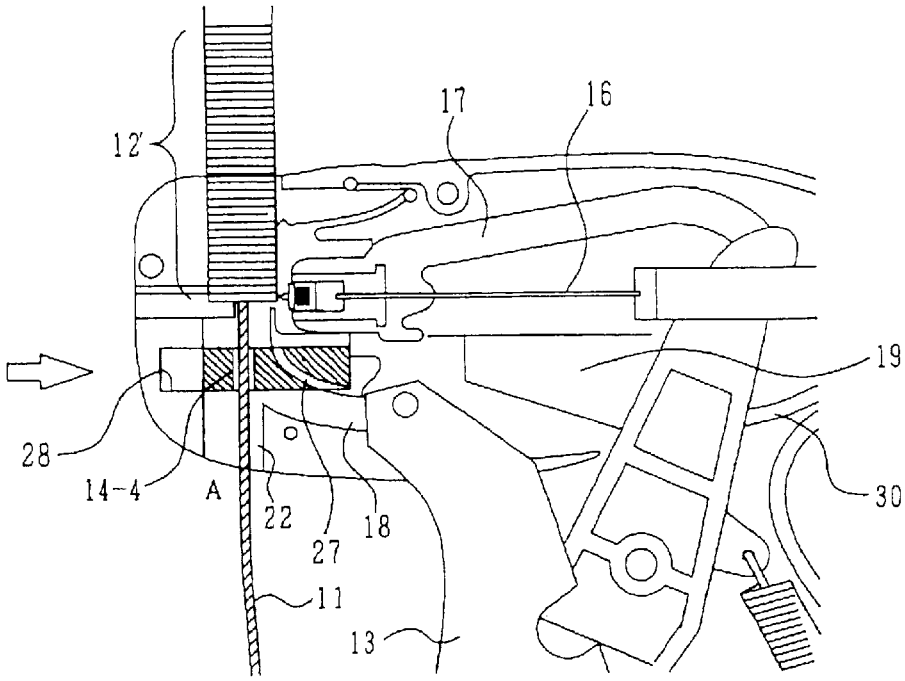
FIG. 14 is a side elevation view for illustrating a fifth embodiment of the fastening element attaching device according to the present invention.
Figure 15:
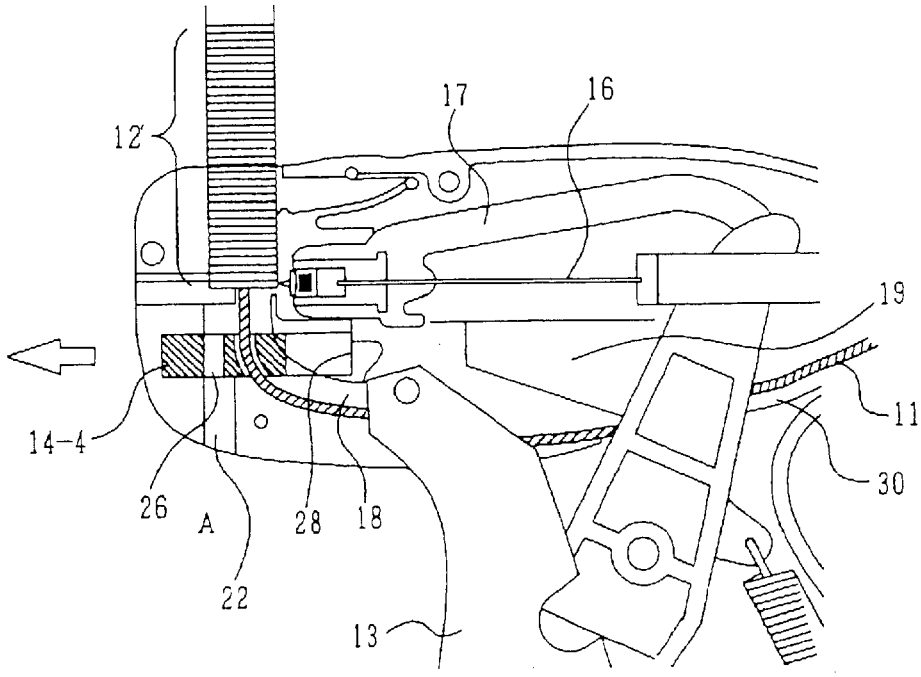
FIG. 15 is a side elevation view for illustrating a fifth embodiment of the fastening element attaching device according to the present invention.
Figure 16:
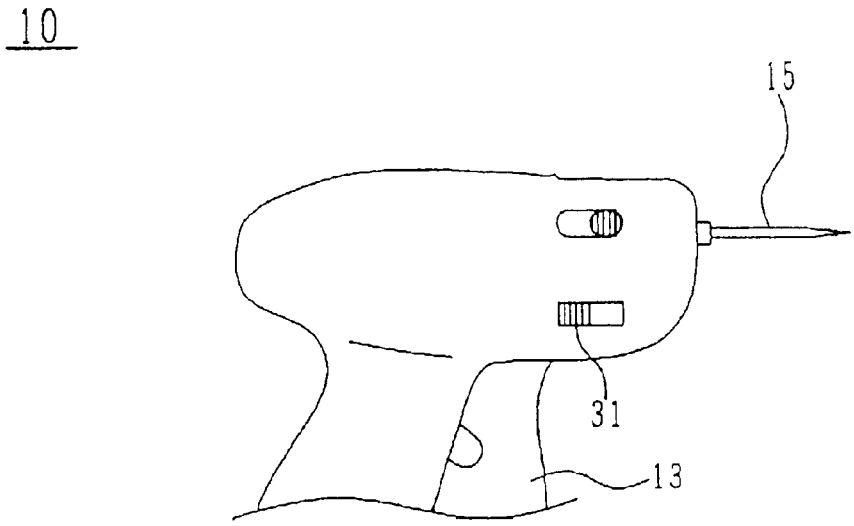
FIG. 16 is a side elevation view for illustrating a switching lever 31, which is used in the fastening element attaching device according to the present invention.
Figure 17:
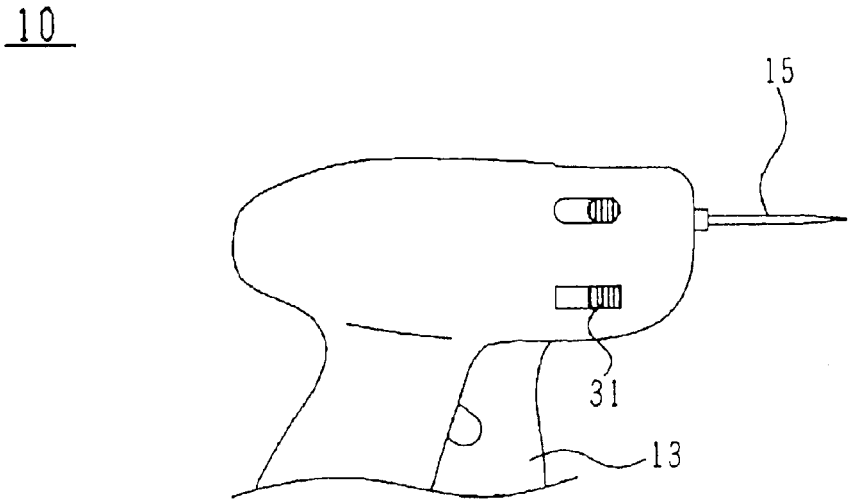
FIG. 17 is a side elevation view for illustrating a switching lever 31, which is used in the fastening element attaching device according to the present invention.
Figure 18:
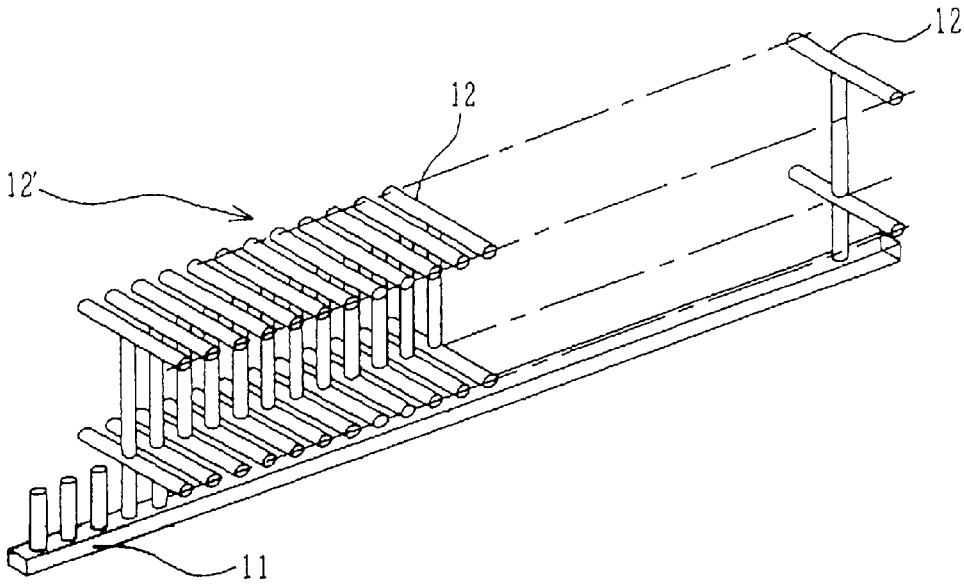
FIG. 18 is a perspective view for illustrating an example of the fastening element group, which is used in the fastening element attaching device according to the present invention.

FIGS. 11 to 13 are explanatory views for illustrating an operating procedure of the switching lever 23. FIG. 11 is a view of the switching lever 23 from one side face of the fastening element attaching device. The switching member 14-3 is capable of being switched by rotating the switching lever 23 in the directions represented by arrows. FIG. 12 shows a case that the switching lever 23 is pushed into in a direction represented by an arrow X and is fixed so that the switching lever 23 is not rotated and the switching member is not moved in the operation. Alternatively, FIG. 13 shows an example such that the switching lever 23 is pushed out to a direction represented in an arrow Y so that the switching lever 23 is capable of being rotated. Under this condition, it becomes possible to switch the switching member for the first time. FIGS. 14 and 15 are side elevation views for illustrating a fifth embodiment of the fastening element attaching device according to the present invention. According to the present invention, the switching member is configured by a slide switching member 14-4 and it is inserted in a groove 28, which is defined in the main portion of the device, slidably. Operating this switching member 14-4 is capable of changing a course of the connection bar 11. The switching member 14-4 is configured in a tabular shape and two passages 26 and 27 are defined. Additionally, a switching lever 31 shown in FIGS. 16 and 17 is capable of sliding the switching member 14-4. FIG. 14 shows a case that the switching member 14-4 is slid in a right direction in the drawing and the connection bar 11 is set so as to be guided to the passage 26. This corresponds to FIG. 16. When the connection bar 11 is guided to the passage 26, the connection bar 11 is discharged from the discharging orifice A at a lower edge of a front part of the main portion of the device. Alternatively, FIG. 15 shows a case that the switching member 14-4 is slid in right and left directions in the drawing and the connection bar 11 is set so as to be guided to the passage 27. This corresponds to FIG. 17. When the connection bar 11 is guided to the passage 27, the connection bar 11 is discharged from the discharging orifice B through the second passage 18 of the main portion of the device. According to the embodiment, it is possible to switch the discharging position through one touch operation by the switching lever 31.

Alternatively, according to the above described embodiments, an example such that the discharging position is switched through one touch operation by the switching mechanism is described. However, after the fastening elements are detached from the connection bar 11, this remaining connection bar 11 may be discharged only from the discharging orifice B at a rear part of the main portion of the device through the second passage 18 of the main portion of the device without disposing the discharging orifice A on the switching mechanism and the main portion of the device. Also, the connection bar 11 may be discharged only from the low part of the discharging orifice C of the operational lever 13 through the second passage 18 of the main portion of the device and the operational lever 13.

The present invention is not limited to the above described examples but it is possible to provide various designs on the basis of a technical concept of the present invention.

Figure 19:
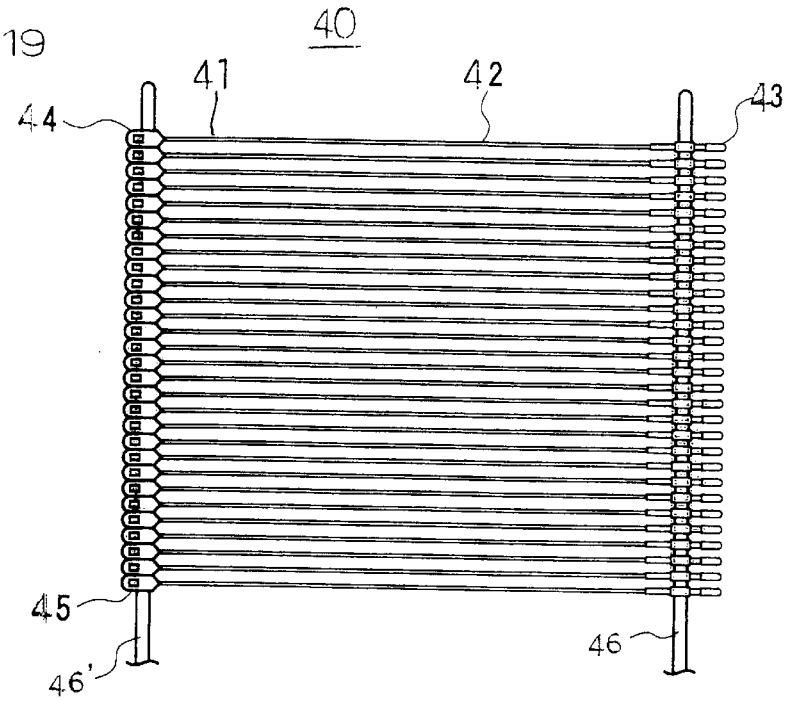
FIG. 19 is a plane view showing another embodiment of a fastening element group different from the above mentioned.
Figure 20:
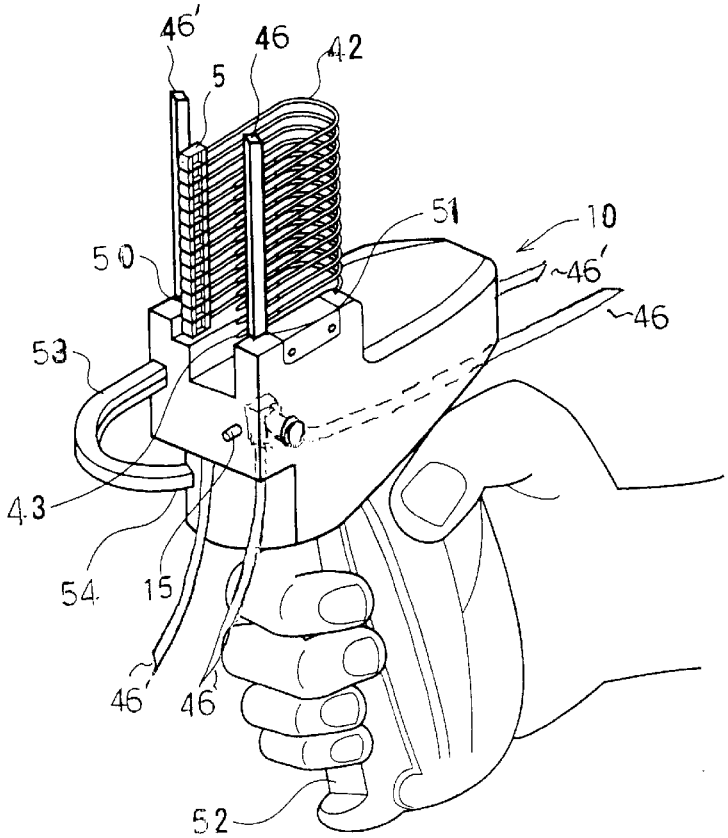
FIG. 20 is a perspective view for illustrating another embodiment of a fastening element attaching device to which the present invention can be applied.

For example, as shown in FIGS. 19 and 20, the present invention can also be applied to a fastening element attaching device in that a separate fastening element group in which a plurality of fastening elements being supported by two connecting bars is used.

In these drawings, a fastening element group 40 is shown and it comprises a plurality of fastening elements 41 each having a flexible filament part 42, an insertion head 43 having an appropriate engaging part, and provided on one end of the filament part 42, and a socket part 45 having an insertion hole 44 for irreversible passing of the insertion head part 43, and provided on the other end of the filament part 42 are arranged so that the filament parts 42 thereof are mutually adjacent and parallel, with each of the plurality of insertion head parts 43 or a portion proximity thereto and socket parts 45 or a portion proximity thereto, being caused to be connected to separately provided connection bar 46 and 46'.

FIG. 20, shows a separate fastening element attaching device 10 from the fastening element attaching device as explained above, and it has formed in it a vertical grooves 50 and 51 into which each one of the connection bars 46 and 46' are inserted, respectively.

For example, the connection bar 46' linked to a socket part 45 of the fastening element sealing implement 41 is inserted into the vertical groove 50, and the connection bar 46 linked to the insertion head part 43 is inserted into the vertical groove 51.

A shooting pin (not shown in the drawing) is arranged in a sideways direction of the vertical groove 51, this pin being driven by the lever 52 of the fastening element attaching device 10, the insertion head part 43 being separated from the connection bar 46, and pushed out and frontward, along a cylindrically shaped guide pin 15.

The socket 45 supported by the connection bar 46' is inserted into the vertical groove 50 is separated by a push-out belt (not shown in the drawing) from the connection bar 46', and is pushed out and frontward one by one, along a curved socket part guide 53.

Since the present invention employs various constitutions as described above, it is possible to discharge the connection bar from a rear edge of the main portion of the device even when a long fastening element group (pin) is used. Accordingly, even when the long fastening element group is used, the operability is capable of being improved. Alternatively, there is no possibility to damage the commodities and to hurt fingers and hands of the operator by the connection bar. Additionally, in the case that a short fastening element group is used, it is possible to discharge it from a front part of the main portion of the device.

What is claimed is:

1. A fastening element attaching device for sequentially detaching fastening elements from a bar to which a plurality of the fastening elements are affixed, the device comprising:

a main body with two separate and spaced apart exit ports through which the bar selectively moves after the fastening elements have been detached from the bar;

a control member that operates the device by moving the bar through said main body; and a switch that selects one of said two exit ports through which the bar is to move after the fastening elements have been detached.

2. The device of claim 1, wherein said two exit ports are located at a rear and a bottom of said main body.

3. The device of claim 2, wherein said main body defines a first path for the bar before the fastening elements have been detached and two separate second paths for the bar after the fastening elements have been detached, each of said two second paths leading to a respective one of said two exit ports, said switch being inside said main body at a junction of said first path and said two second paths.

4. A fastening element attaching device for sequentially detaching fastening elements from a bar to which a plurality of the fastening elements are affixed, the device comprising:

a main body with a first path for the bar before the fastening elements have been detached from the bar and two separate second paths for the bar after the fastening elements have been detached from the bar, each of said two second paths extending from said first path to a respective one of two spaced apart exit ports;

a control member that operates the device by moving the bar through said first path and one of said second paths; and a selector that selects one of said two second paths through which the bar is to move.

5. The device of claim 4, wherein said two exit ports are located at a rear and a bottom of said main body.

* * * * *